US007669753B2

(12) United States Patent
West

(10) Patent No.: US 7,669,753 B2
(45) Date of Patent: Mar. 2, 2010

(54) BOX FLAP LOCKING SYSTEM

(75) Inventor: Thomas West, Greenfield Center, NY (US)

(73) Assignee: Norampac Schenectady, Inc., Schenectady, NY (US)

( * ) Notice: Subject to any disclaimer, the term of this patent is extended or adjusted under 35 U.S.C. 154(b) by 178 days.

(21) Appl. No.: 11/848,542

(22) Filed: Aug. 31, 2007

(65) Prior Publication Data

US 2009/0072017 A1 Mar. 19, 2009

Related U.S. Application Data

(63) Continuation of application No. 10/800,588, filed on Mar. 15, 2004, now Pat. No. 7,278,565.

(60) Provisional application No. 60/487,353, filed on Jul. 15, 2003.

(51) Int. Cl.
*B65D 5/10* (2006.01)

(52) U.S. Cl. ..... 229/109; 229/155; 229/158; 229/185

(58) Field of Classification Search ..... 229/110, 229/156, 157
See application file for complete search history.

(56) References Cited

U.S. PATENT DOCUMENTS

| | | | |
|---|---|---|---|
| 902,213 | A | 10/1908 | Davidson |
| 1,028,195 | A | 6/1912 | Davidson |
| 1,092,210 | A | 4/1914 | Greve |
| 1,769,183 | A | 7/1930 | Laubenheimer |
| 1,779,403 | A | 10/1930 | Greve |
| 2,373,423 | A | 4/1945 | Shina |
| 2,666,567 | A | 1/1954 | Farrell |
| 3,037,681 | A | 6/1962 | Kuchenbecker et al. |
| 3,182,888 | A | 5/1965 | Chidsey, Jr. et al. |
| 3,319,869 | A | 5/1967 | Ostwald |
| 3,374,937 | A | 3/1968 | Wilson |
| 3,432,085 | A | 3/1969 | Lock |
| 3,642,192 | A | 2/1972 | Wilcox, Jr. et al. |
| 3,669,341 | A | 6/1972 | Hughes |
| 3,770,187 | A | 11/1973 | Faires et al. |
| 3,792,810 | A | 2/1974 | Tingley et al. |
| 3,829,005 | A | 8/1974 | Hackenberq et al. |
| 4,013,213 | A | 3/1977 | Giebel |
| 4,027,818 | A | 6/1977 | Stoll |
| 4,600,142 | A | 7/1986 | Quaintance |
| 4,793,546 | A | 12/1988 | Nunn |
| 4,899,927 | A | 2/1990 | Straub et al. |
| 5,390,790 | A | 2/1995 | Straub et al. |
| 5,573,175 | A | 11/1996 | Straub et al. |
| 6,012,629 | A | 1/2000 | Newcomer |
| 6,206,279 | B1 | 3/2001 | Countee |
| 6,364,200 | B1 | 4/2002 | Moss et al. |
| 6,386,437 | B1 | 5/2002 | Larson, Jr. |
| 6,431,435 | B1 | 8/2002 | Jones et al. |
| 6,446,859 | B1 | 9/2002 | Holladay |
| 6,688,514 | B2 | 2/2004 | Evans et al. |
| 6,834,792 | B1 | 12/2004 | Perkins |
| 7,159,761 | B2 | 1/2007 | Abshire et al. |
| 7,278,565 | B2 * | 10/2007 | West ..... 229/109 |
| 2003/0192945 | A1 | 10/2003 | Quaintance |
| 2004/0182916 | A1 | 9/2004 | Roseth |

* cited by examiner

*Primary Examiner*—Gary E Elkins
(74) *Attorney, Agent, or Firm*—Michael Hoffman; Hoffman Warnick LLC

(57) ABSTRACT

The invention provides a foldable box design having a box flap locking system, comprising: a first flap having an edge with a generally trapezoidal shaped tab cut therein, wherein said generally trapezoidal shaped tab is defined by two inwardly projecting grooves; and a second flap that locks with the first flap, wherein the second flap includes an edge with a second generally trapezoidal shaped tab cut therein, and wherein said second generally trapezoidal shaped tab is defined by two outwardly projecting grooves.

4 Claims, 5 Drawing Sheets

BOX FLAP LOCKING SYSTEM

CLAIM OF PRIORITY

This continuation application claims priority to patent application Ser. No. 10/800,588, filed on Mar. 15, 2004, now U.S. Pat. No. 7,278,565 which claimed priority to U.S. Provisional Application Ser. No. 60/487,353, filed on Jul. 15, 2003, both entitled "BOX FLAP LOCKING SYSTEM," the contents of both are hereby incorporated by reference.

BACKGROUND OF THE INVENTION

1. Technical Field

The present invention relates generally to foldable containers, and more specifically relates to a box flap locking system.

2. Related Art

The ability to securely lock flaps of a foldable cardboard box (or similar type container) remains an ongoing problem. The problem is particularly challenging for a bottom side of the box where significant weight and stress can occur. For instance, in an 8-sided box, current designs utilize flaps that can easily become disengaged when stresses are place onto a loaded box. Accordingly, tape or other means, such as lock tabs, are required to hold the bottom flaps securely together. However, current lock tab designs protrude up and through the bottom inside of the box and can, for instance, catch on and tear a poly liner often used within boxes. Accordingly, a need exists for a foldable box design that included flap that can be securely locked without interfering with the interior space of the box.

SUMMARY OF THE INVENTION

The present invention addresses the above-mentioned problems, as well as others, by providing a foldable box design having a box flap locking system. In a first aspect, the invention provides a foldable box having a flap locking system, comprising: a first flap having an edge with a generally trapezoidal shaped tab cut therein, wherein said generally trapezoidal shaped tab is defined by two inwardly projecting grooves; and a second flap that locks with the first flap, wherein the second flap includes an edge with a second generally trapezoidal shaped tab cut therein, and wherein said second generally trapezoidal shaped tab is defined by two outwardly projecting grooves.

In a second aspect, the invention provides a one-piece, collapsible container, comprising: a plurality of side wall panels foldably joined to each other; a plurality of flaps, each flap being foldably joined to an edge of a side wall panel; and an interlocking mechanism residing on a first and second opposing flaps, wherein: the first opposing flap includes an edge with a first tab cut therein, wherein the first tab is defined by two inwardly projecting grooves; and the second opposing flap locks with the first opposing flap, and includes an edge with a second tab cut therein, wherein the second tab is defined by two outwardly projecting grooves.

In a third aspect, the invention provides an interlocking mechanism residing on a first and second opposing member, wherein: the first member includes an edge with a first trapezoidal shaped tab cut therein, wherein the first trapezoidal shaped tab is defined by two inwardly projecting grooves; and the second member locks with the first member and includes an edge with a second trapezoidal shaped tab cut therein, wherein the second trapezoidal shaped tab is defined by two outwardly projecting grooves.

In a fourth aspect, the invention provides a foldable box having a flap locking system, comprising: a first flap having first cutout regions removed along a first edge to form a pair of receiving tabs and a first generally trapezoidal shaped tab between the receiving tabs, wherein said generally trapezoidal shaped tab projects outwardly towards the first edge an includes two inwardly projecting grooves formed from the first cutout regions along a first common axis; a second flap having second cutout regions removed along a second edge to form a pair of locking tabs and a second generally trapezoidal shaped between the locking tabs, wherein each locking tab includes an outwardly projecting groove formed from the second cutout regions along a second common axis; and wherein when the flap locking system is secured, the second generally trapezoidal shaped tab substantially overlaps and covers the first generally trapezoidal shaped tab and the receiving tabs substantially overlap and cover the locking tabs.

In a fifth aspect, the invention provides interlocking mechanism implemented on opposing edges of a first member and a second member, wherein: the first member includes an edge with a first trapezoidal shaped tab cut therein, wherein the first trapezoidal shaped tab projects outwardly towards the edge and is defined by two inwardly projecting grooves that extend toward each other along a first common axis; the second member locks with the first member and includes an edge with a second trapezoidal shaped tab cut therein, wherein the second trapezoidal shaped tab projects outwardly towards the edge of the second member, and wherein the second member includes two outwardly projecting grooves that extend away from each other along a second common axis; and the second trapezoidal shaped tab substantially overlaps and covers the first trapezoidal shaped tab when secured.

In a sixth aspect, the invention provides an interlocking mechanism implemented between opposing members, comprising: a first member having a first outer edge and a pair of first side edges, the first member including a first trapezoidal shaped tab cut in the first outer edge and a pair of receiving tabs formed along the first pair of side edges, wherein the first trapezoidal shaped tab projects outwardly towards the first outer edge; a second member having a second outer edge and a second pair of side edges, the second member including a second trapezoidal shaped tab cut in the second outer edge and a pair of locking tabs formed along the second pair of side edges, wherein the second trapezoidal shaped tab projects outwardly towards the second outer edge; and wherein the second trapezoidal shaped tab substantially overlaps and covers the first trapezoidal shaped tab when the first and second member interlock.

BRIEF DESCRIPTION OF THE DRAWINGS

These and other features of this invention will be more readily understood from the following detailed description of the various aspects of the invention taken in conjunction with the accompanying drawings in which.

DETAILED DESCRIPTION OF THE INVENTION

Figure 1:
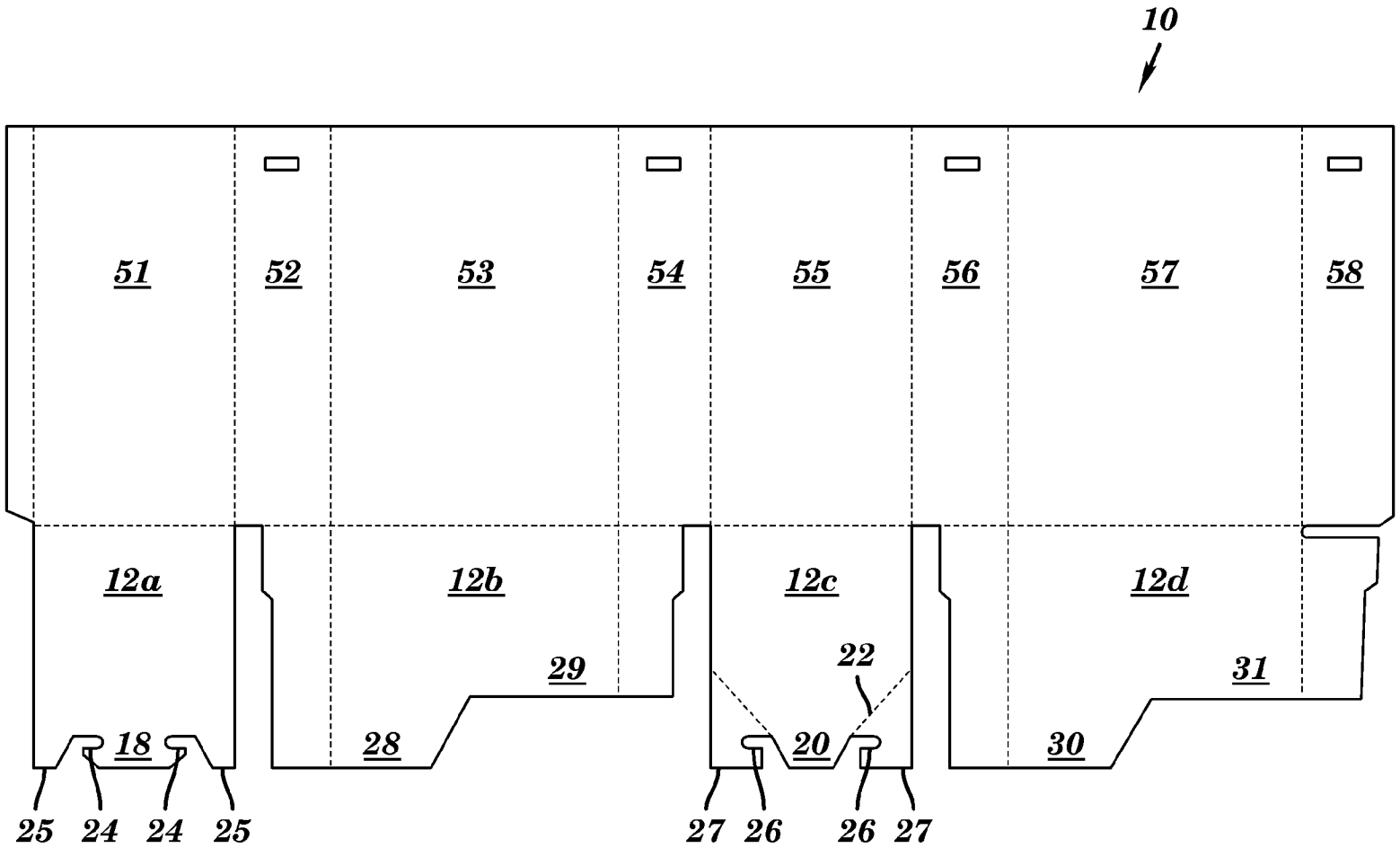
FIG. 1 depicts a detailed view of the unfolded box in accordance with the invention.

Referring now to FIG. 1, an exemplary embodiment of the invention is shown comprising an octagonal laminated box 10 in an unfolded form having a locking flap system. Box 10 includes eight sidewall sections indicated as S1-S8, and four bottom sections or flaps indicated as 12*a-d*. The dotted lines indicate fold lines for assembling the box. Two of the flaps, 12*a* and 12*c* have edges that include specially formed tabs 18 and 20, which allow the two flaps 12*a* and 12*c* to interconnect and secure the bottom of box 10.

Flap 12*a* comprises a generally trapezoidal shaped tab 18 with inwardly projecting grooves 24. Also included on flap 12*a* is a pair of receiving tabs 25 which are cut away from tab 18. Flap 12*c* comprises a generally trapezoidal shaped tab 20 with outwardly projecting grooves 26. Also included on flap 12*c* is a pair of locking tabs 27, which are cut toward the tab 20. Flap 12*c* includes a pair of fold lines 22 that facilitates interlocking between flaps 12*a* and 12*c*. When the flaps are brought together and corners are diagonally folded along lines 22 of flap 12*c*, the flaps interlock, forming a solid connection that cannot be separated without considerable effort or tearing.

Sections S3 and S7 also include bottom flaps 12*b* and 12*d*. Each flap includes an extended portion 28, 30 and a recessed portion 29, 31, thus forming a generally L-shaped edge. Flaps 12*b* and 12*d* overlap and interlock, as described below.

Figure 2:
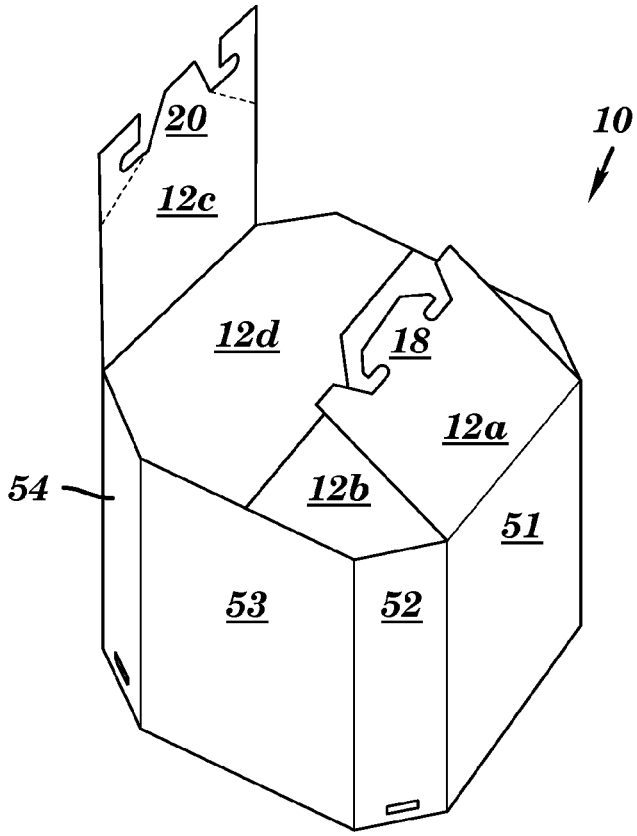
FIG. 2 depicts a bottom view of a partially folded box in accordance with the invention.

FIG. 2 depicts a bottom view of box 10 in a partially folded state. As can be seen, when the box is folded, flap 12*a* meets up with 12*c*, allowing tab 18 to interlock with tab 20. Utilizing this design, the bottom flaps 12*a-d* of box 10 can be locked together without tape, staples, etc. Moreover, the resulting self-locking design will not protrude through to the inside bottom of box 10 to create an uneven bottom surface. Instead, this design provides a virtually smooth bottom inside the box, as the locking system is totally implemented on the outside of box 10.

Figure 3:
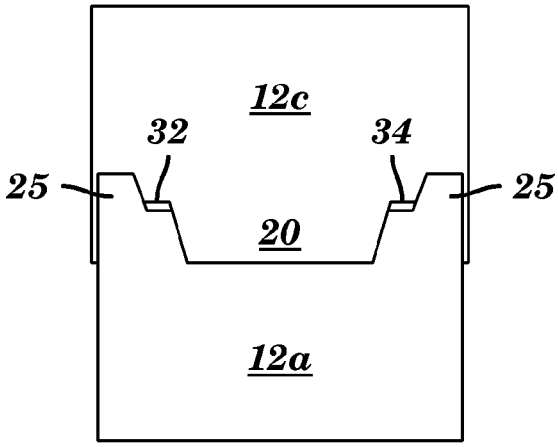
FIG. 3 depicts a view of flaps in the locked position in accordance with the invention.

To fold box 10, flaps 12*b* and 12*d* are first folded together such that the extended portions 28 and 30 of the flaps interlock with the recessed portions 31 and 29, respectively, to form a generally flat surface on the bottom of box 10. Next, flaps 12*a* and 12*c* are secured and locked together externally to flaps 12*b* and 12*d*. FIG. 3 depicts a view of the two flaps 12*a* and 12*e* interlocked together. As can be seen, tab 20 of flap 12*c* sits on top of tab 18 (not shown) of flap 12*a*, and receiving tabs 25 of flap 12*a* sit on top of flap 12*c*. The inwardly and outwardly projecting grooves 24, 26 of the two flaps join at locations 32 and 34.

Figure 4:
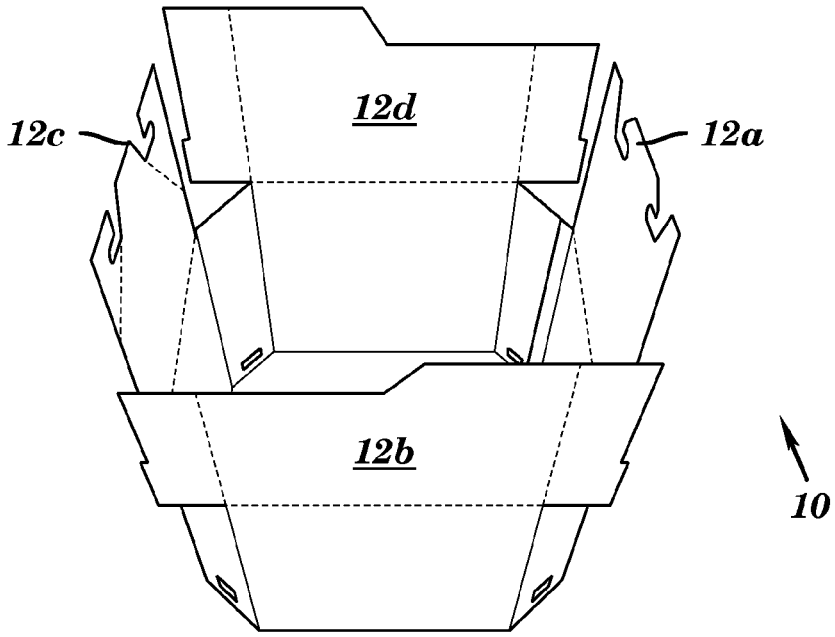
FIGS. 4-9 depict a method of closing the box of FIG. 1.
Figure 5:
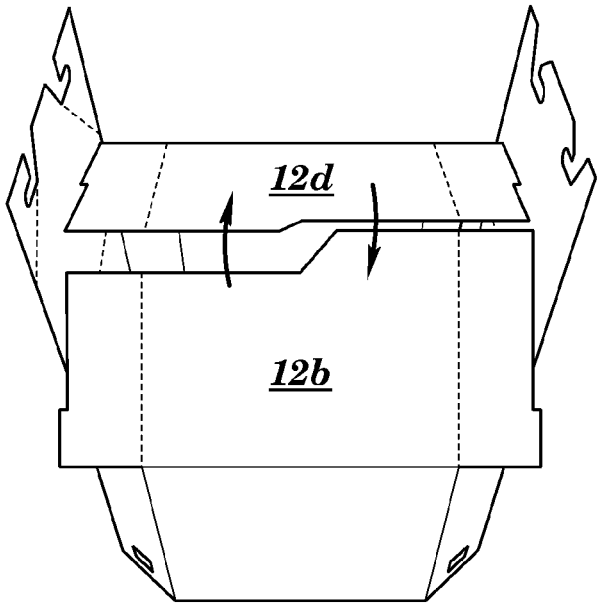
Figure 6:
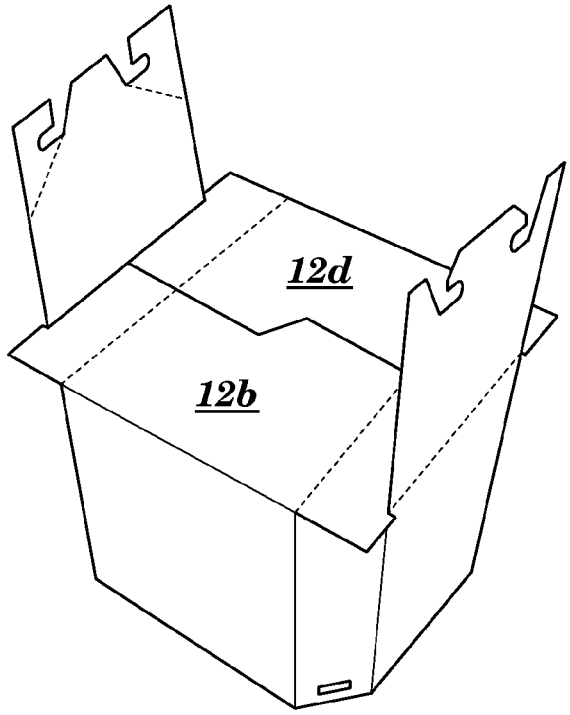
Figure 7:
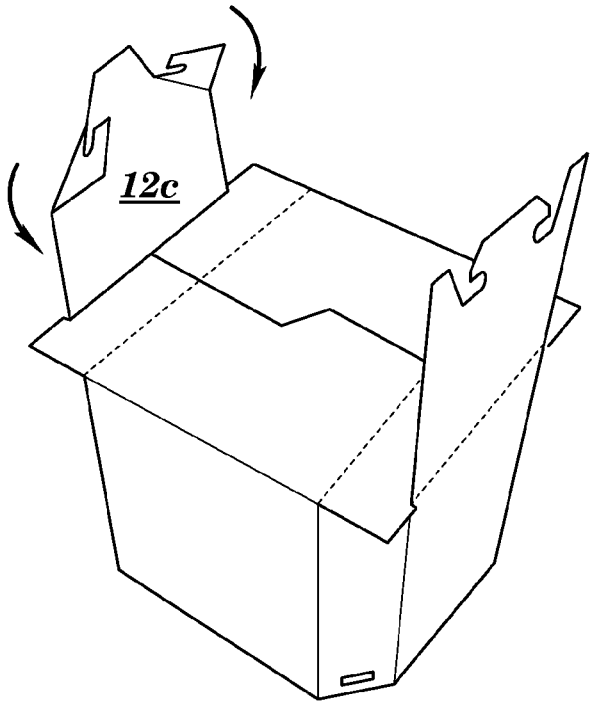
Figure 8:
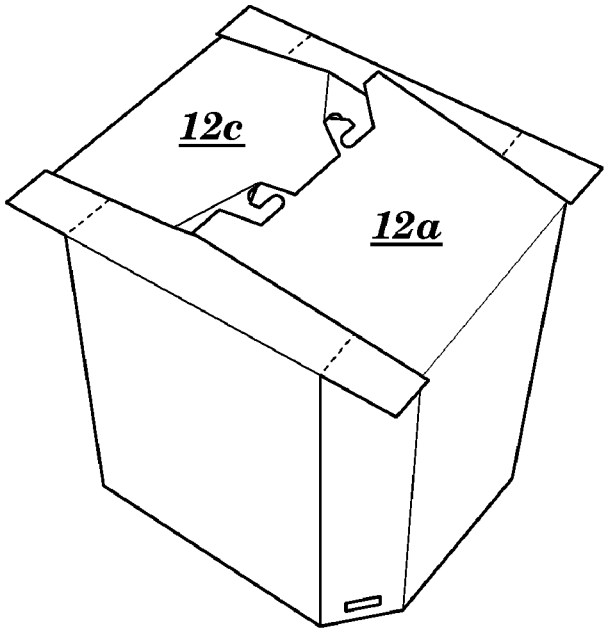
Figure 9:
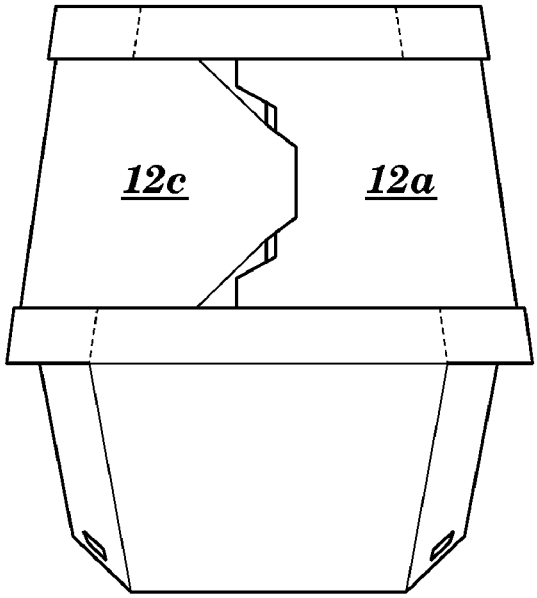

FIGS. 4-9 depict a complete method of closing the bottom flaps of box 10. In a first step, FIG. 4 depicts the bottom of box 10 with the flaps 12*a-d* extending upward. FIG. 5 depicts a second step in which flaps 12*b* and 12*d* are folded inwardly, resulting in the configuration shown in FIG. 6. FIG. 7 depicts a third step in which the corners of flap 12*c* are folded as shown by the directional arrows. FIG. 8 depicts a fourth step in which flaps 12*a* and 12*c* are interlocked, resulting in the configuration shown in FIG. 9.

While the invention is described with reference to 8-sided bulk container box, it is understood that the described locking flap system could be used in other applications, e.g., in a single wall four-sided box, to lock a box top or side, etc. The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

What is claimed is:

1. A foldable box having a flap locking system, comprising:

a first flap having first cutout regions removed along a first edge to form a pair of receiving tabs and a first generally trapezoidal shaped tab between the receiving tabs, wherein said generally trapezoidal shaped tab projects outwardly towards the first edge and includes two inwardly projecting grooves formed from the first cutout regions along a first common axis;

a second flap having second cutout regions removed along a second edge to form a pair of locking tabs and a second generally trapezoidal shaped tab between the locking tabs, wherein each locking tab includes an outwardly projecting groove formed from the second cutout regions along a second common axis; and wherein both the first and second generally trapezoidal shaped tabs have an outer edge that extends along a third common axis, and wherein in a secured position, the second generally trapezoidal shaped tab substantially overlaps and covers the first generally trapezoidal shaped tab and the receiving tabs substantially overlap and cover the locking tabs.

2. An interlocking mechanism implemented on opposing edges of a first member and a second member, wherein:

the first member includes an edge with a first trapezoidal shaped tab cut therein, wherein the first trapezoidal shaped tab projects outwardly towards the edge and is defined by two inwardly projecting grooves that extend toward each other along a first common axis;

the second member locks with the first member and includes an edge with a second trapezoidal shaped tab cut therein, wherein the second trapezoidal shaped tab projects outwardly towards the edge of the second member, and wherein the second member includes two outwardly projecting grooves that extend away from each other along a second common axis;

the first and second trapezoidal shaped tabs each have an outer edge that extends along a third common axis; and the second trapezoidal shaped tab substantially overlaps and covers the first trapezoidal shaped tab when secured.

3. The interlocking mechanism of claim 2, wherein the first member further includes a pair of receiving tabs that are cut away from the first trapezoidal shaped tab and the second member further includes a pair of locking tabs that are cut toward the second trapezoidal shaped tab, and wherein the pair of receiving tabs substantially overlap and cover the locking tabs when secured.

4. An interlocking mechanism implemented between opposing members, comprising:

a first member having a first outer edge and a pair of first side edges, the first member including a first trapezoidal shaped tab cut in the first outer edge and a pair of receiving tabs formed along the first pair of side edges, wherein the first trapezoidal shaped tab projects outwardly towards the first outer edge;

a second member having a second outer edge and a second pair of side edges, the second member including a second trapezoidal shaped tab cut in the second outer edge and a pair of locking tabs formed along the second pair of side edges, wherein the second trapezoidal shaped tab projects outwardly towards the second outer edge, and wherein the pair of locking tabs and pair of receiving tabs have outer edges that extend along a common axis; and wherein the second trapezoidal shaped tab substantially overlaps and covers the first trapezoidal shaped tab when the first and second member interlock.

* * * * *